US009988778B2

(12) United States Patent
Barnas et al.

(10) Patent No.: US 9,988,778 B2
(45) Date of Patent: Jun. 5, 2018

(54) BARRIER WALL ELEMENT

(71) Applicant: KIRCHDORFER FERTIGTEILHOLDING GMBH, Wöllersdorf (AT)

(72) Inventors: Alexander Barnas, Vienna (AT); Franz Spitzer, Warth/Kirchau (AT)

(73) Assignee: KIRCHDORFER FERTIGTEILHOLDING GMBH, Wöllersdorf (AT)

( * ) Notice: Subject to any disclaimer, the term of this patent is extended or adjusted under 35 U.S.C. 154(b) by 0 days. days.

(21) Appl. No.: 15/327,931

(22) PCT Filed: Jun. 17, 2015

(86) PCT No.: PCT/AT2015/000089
§ 371 (c)(1),
(2) Date: Jan. 20, 2017

(87) PCT Pub. No.: WO2016/011465
PCT Pub. Date: Jan. 28, 2016

(65) Prior Publication Data

US 2017/0204576 A1 Jul. 20, 2017

(30) Foreign Application Priority Data

Jul. 23, 2014 (AT) ..... A 585/2014

(51) Int. Cl.
*E01F 15/08* (2006.01)

(52) U.S. Cl.
CPC ..... *E01F 15/088* (2013.01); *E01F 15/083* (2013.01)

(58) Field of Classification Search
CPC ..... E01F 15/02; E01F 15/08; E01F 15/088; E01F 13/02

(Continued)

(56) References Cited

U.S. PATENT DOCUMENTS 3,338,285 A * 8/1967 Jaster ..... B65D 33/2541 24/DIG. 50
3,918,131 A * 11/1975 Ausnit ..... A44B 19/16 24/586.1

(Continued)

FOREIGN PATENT DOCUMENTS

EP 1 467 028 A1 10/2004
WO WO 2010/057232 A1 5/2010
WO WO 2010/057233 A1 5/2010

OTHER PUBLICATIONS

English International Search Report issued by the European Patent Office in International Application PCT/AT2015/000089.

*Primary Examiner* — Gary S Hartmann
(74) *Attorney, Agent, or Firm* — Henry M. Feiereisen LLC

(57) ABSTRACT

A barrier wall element of a vehicle restraint system includes a coupling part having a first leg which has a free end forming a first hook extension and a sliding surface arranged on a side of the first leg. The side faces away from the first hook extension, and a second leg has a free end forming a second hook extension. When coupling the coupling part to an identical coupling part of another barrier wall element, the first hook extension rests in a first contact region on the second hook extension of a further coupling part. The second hook extension rests in a second contact region on the first hook extension of the further coupling part. The first and second contact regions are spaced from one another in a tensile direction of the tension member by a distance which is smaller than a width of the first leg.

16 Claims, 2 Drawing Sheets

(58) Field of Classification Search
USPC ..... 404/6
See application file for complete search history.

(56) References Cited

U.S. PATENT DOCUMENTS

| | | | | | |
|---|---|---|---|---|---|
| 4,008,575 | A * | 2/1977 | Gallagher | E02B 15/08 | 24/586.11 |
| 5,149,224 | A * | 9/1992 | Smith | E01F 15/088 | 256/13.1 |
| D421,235 | S * | 2/2000 | Rausch | D10/113.3 | |
| 7,607,645 | B2 * | 10/2009 | Smith | E01F 15/083 | 256/13.1 |
| 8,328,461 | B2 * | 12/2012 | Smith | E01D 19/103 | 256/13.1 |
| 8,388,257 | B2 * | 3/2013 | Redlberger | E01F 15/083 | 256/13.1 |
| 9,422,681 | B2 * | 8/2016 | Smith | E01F 15/083 | |
| 2013/0272551 | A1 | 10/2013 | Barnas | | |
| 2016/0010294 | A1 * | 1/2016 | McMaster | E01F 15/088 | 404/6 |
| 2016/0369461 | A1 * | 12/2016 | McMaster | E01F 15/088 | |

* cited by examiner

BARRIER WALL ELEMENT

CROSS-REFERENCES TO RELATED APPLICATIONS

This application is the U.S. National Stage of International Application No. PCT/AT2015/000089, filed Jun. 17, 2015, which designated the United States and has been published as International Publication No. WO 2016/011465 and which claims the priority of Austrian Patent Application, Serial No. A 585/2014, filed Jul. 23, 2014, pursuant to 35 U.S.C. 119(a)-(d).

BACKGROUND OF THE INVENTION

The invention relates to a barrier wall element of a vehicle restraint system.

Conventional barrier wall elements comprise coupling parts in order to couple the barrier wall elements to each other and to thus form a continuous vehicle restraint system. The vehicle restraint system is used for restraining impacting vehicles, wherein the coupling part is provided to be coupled to a coupling part of another barrier wall element in order to connect the individual barrier wall elements to form a continuous tension member, which in the case of an impact of a vehicle against one of the barrier wall elements conducts the impact energy to a greater number of barrier wall elements and thus prevents the vehicle from breaking through the vehicle restraint system.

Coupling parts are known which comprise two different but diametrically opposed profiles, which can be inserted to form an interlocking connection.

It is disadvantageous that such coupling parts are cumbersome in handling. Furthermore, the coupling parts are made of high-quality materials, which is why multipart or massive coupling parts of complex configuration are disadvantageous.

SUMMARY OF THE INVENTION

It is therefore the object of the invention to provide a barrier wall element of a vehicle restraint system of the kind mentioned above with which the aforementioned disadvantages can be avoided, which allows simple handling, which can take up and conduct high tensile forces, but which still is formed in a simple and material-saving manner.

This is achieved in accordance with the invention a barrier wall element of a vehicle restraint system, including at least one coupling part in order to connect a plurality of barrier wall elements to form a continuous tension member, wherein the coupling part has a first leg, having a first width, with a first hook extension at a free end of the first leg, and a second leg with a second hook extension at a free end of the second leg, wherein the coupling part can be coupled to a further coupling part formed identically to the coupling part, wherein, in a coupled state of the coupling parts, the first hook extension rests in a first contact region on the second hook extension of the further coupling part, and the second hook extension rests in a second contact region on the first hook extension of the further coupling part, wherein a sliding surface is arranged on a side of the first leg which faces away from the first hook extension, wherein, in the coupled state, the sliding surface faces a sliding surface of the first leg of the further coupling part, and wherein the distance between the first contact region from the second contact region as measured in the tensile direction of the tension member is smaller than the first width of the first leg.

This leads to the advantage that a barrier wall element can be formed which is easy to handle because the barrier wall element can be coupled on both face ends irrespective of its orientation and without any intermediate pieces.

As a result of the shape of the coupling part, it is advantageously formed in an especially tension-resistant and material-saving manner because the occurring tensile forces can be divided evenly among the two limbs, and an interlocking connection of two coupling parts is still reliably provided even in the case of a commencing deformation.

The dependent claims relate to further advantageous embodiments of the invention.

Express reference is hereby made to the wording of the claims, as a result of which the claims are inserted at this point by reference into the description and are regarded as literally reproduced.

BRIEF DESCRIPTION OF THE DRAWING

The invention will be explained below by reference to the enclosed drawings, which only show preferred embodiments by way of example, wherein.

DETAILED DESCRIPTION OF PREFERRED EMBODIMENTS

Figure 1:
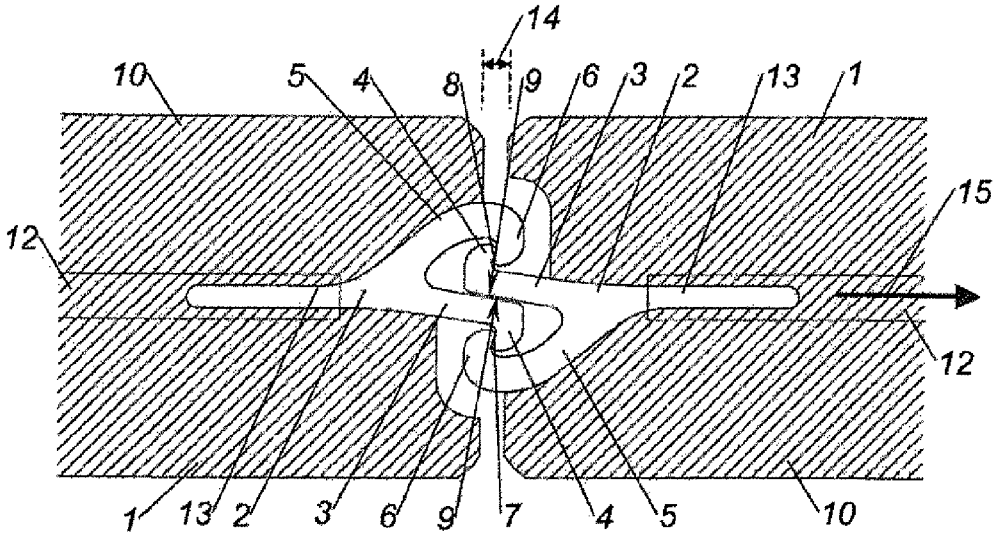
FIG. 1 shows a first preferred embodiment of the barrier wall element as a sectional top view.

FIGS. 1 to 4 show preferred embodiments of a barrier wall element 1 of a vehicle restraint system, comprising at least one coupling part 2 in order to connect several barrier wall elements 1 into a continuous tension member.

The barrier wall element 1 is part of a vehicle restraint system, wherein the barrier wall element 1 can be formed especially as a prefabricated part, preferably as a concrete prefabricated part, which is preferably prefabricated and can subsequently be brought to the operating site. The barrier wall element 1 can especially be formed for arrangement adjacent to a road or between two road lanes.

The barrier wall element 1 comprises at least one coupling part 2, especially one respective coupling part 2 at the face ends, wherein the coupling part 2 is provided to be coupled to a coupling part 2 of a further barrier wall element 1 in order to connect the individual barrier wall elements 6 to form a continuous tension member, which in the case of an impact of a vehicle against one of the barrier wall elements 1 conducts the impact energy to a greater number of barrier wall elements 1 and thus prevents the vehicle from breaking through the vehicle restraint system. Said continuous tension member is mainly subjected to tension in this case. The direction of said tensile loading, which can also be regarded as the predeterminable tensile direction, can preferably correspond to a longitudinal direction of the barrier wall element 1.

It is provided that the coupling part 2 comprises a first leg 3, having a first width and a first hook extension 4 at a free end of said first leg 3, and a second leg 5 with a second hook extension 6 at a free end of the second leg 5. The first width of the first leg 3 is dimensioned transversely to a longitudinal direction of the first leg 3 and to the intended tensile direction. The first width of the first leg 3 can especially be the width of the first leg 3 slightly before the first hook extension 4.

The coupling part 2 can especially be formed in an integral manner.

It is provided that the coupling part 2 can be coupled to a further coupling part 2 which is formed identically to the coupling part 2, wherein the hook extension 4, in a coupled state of the coupling parts 2, rests in a first contact region 7 on the second hook extension 6 of the further coupling part 2, and the second hook extension 6 rests in a second contact region 8 on the first hook extension 4 of the further coupling part 2. The coupling part 2 is therefore formed, for producing a coupled state, to be brought between two barrier wall elements 1 in engagement with an identically formed coupling part 2 of an adjoining barrier wall element 1, wherein the legs 3, 5 of the two coupling parts 2 overlap each other in the region of the free ends.

The first contact region 7 and the second contact region 8 are those regions or areas where the hook extensions 4, 6 are in contact with each other. The contact regions 7, 8 can especially be the surfaces of the hook extensions 4, 6 which are provided for mutual contact.

The hook extensions 4, 6 are especially preferably directed in the same direction, as a result of which they can hook into each other.

The legs 3, 5 can preferably be formed as a perpendicularly progressing profile, as viewed in the operating position of the barrier wall element 1, which legs can be displaced with respect to each other in the vertical direction. The perpendicular in a barrier wall element 1 in the operating position can therefore also be regarded as the direction of displacement of the coupling parts 2.

The legs 3, 5 can especially form a U-shaped or V-shaped profile.

It is further provided that a sliding surface 9 is arranged on a side of the first leg 3 which faces away from the first hook extension 4, wherein, in the coupled state, the sliding surface 9 faces a sliding surface 9 of the first leg 3 of the further coupling part 2. In this case, the legs 3, 5 of the one coupling part 2 form a receptacle for the first leg 3 of the other coupling part 2, wherein the second hook extension 6 of the one coupling part 2 protrudes into said receptacle and thus enters into an interlocking connection with the first leg 3 of the other coupling part 2. The side of the first leg 3 of the one coupling part 2 which faces away from the first hook extension 4 faces the side of the first leg 3 of the other coupling part 2 which faces away from the first extension 4 and can enter into contact with the same. Since the first leg 3 is provided to be accommodated in the receptacle, the first leg 3 can also be designated as the inner leg. The second leg 5, which is arranged on the outside in the coupled state, can also be regarded as the outer leg. As a result of the sliding surface 9 on this side facing away therefrom, the first legs 3 of the two mutually coupled coupling parts 2 do not hook into each other in an interlocking manner, but can slide on each other. As a result, an occurring tensile force is substantially only further conducted via the provided contact regions 7, 8, as a result of which both legs 3, 5 are subjected to tension in a substantially uniform manner. If the first legs 3 of the two mutually coupled coupling parts 2 would hook into each other, i.e. would therefore conduct forces in the tensile direction in an interlocking manner, the first legs 3 would take up a substantially greater component of the tensile force than the second leg 5 and would therefore have to be formed in a substantially wider manner than the second leg 5.

The sliding surface 9 can be free from undercuts, especially in the intended tensile direction. This means that in the direction of the intended tensile direction the sliding surface 9 does not comprise any undercut on which it could interlock. The sliding surface 9 can further be especially flat.

It is further provided that the distance of the first contact region 7 from the second contact region 8 which is measured in the tensile direction of the tension member is smaller than the first width of the first leg 3. This leads to the advantageous effect that even in the case of a high tensile load the connection of the two coupling parts 2, in which the hook extensions 4, 6 already start to deform, still provides a reliable interlocking connection.

In the case of a very high tensile load, failure of the coupling part 2 primarily occurs by a deformation of the legs 3, 5 and the hook extensions 4, 6 before the tensile loading is sufficient to produce a tearing of the legs 3, 5. In this case, a high tensile loading and the thus occurring forces in the contact region 7, 8 produce a force component which tries on the one hand to press the legs 3, 5 apart on the one hand and to bend up the hook extensions 4, 6 on the other hand, wherein the free ends of the legs 3, 5 are subjected to a bending moment.

The first legs 3 are pressed against each other during bending up on the sliding surface 9 and are thus not capable of yielding at first, while the second legs 5 are bent to the outside. It is therefore advantageous to form the second legs 5 as massively as possible in relation to the first legs 3, so that they are well capable of withstanding the force that bends them up. This occurs on the one hand by the sliding surfaces 9, by which the take-up of force in the direction of the tension is divided substantially uniformly among the two legs 3, 5, as a result of which the first leg 3 can be formed in a comparatively slender way.

Figure 2:
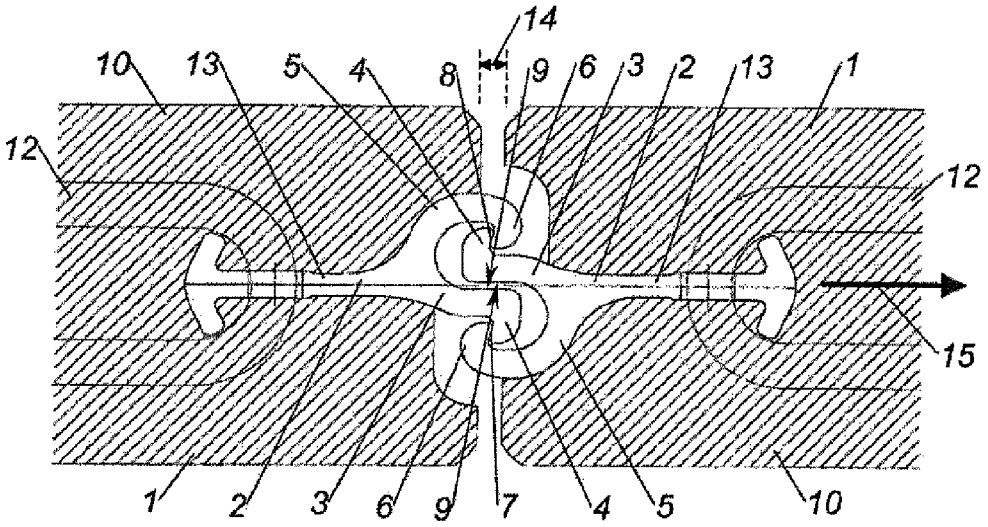
FIG. 2 shows a second preferred embodiment of the barrier wall element as a sectional top view.

Since the distance of the first contact region 7 from the second contact region 8 in the tensile direction is smaller than the first width of the first leg 3, the first legs 3, which rest on each other, are pressed against each other in a region which is already reinforced by the hook extensions 4. As a result of the bending up of the first hook extensions 4, the introduction of force at the outermost contact point, as seen in the tensile direction, of the sliding service 9 is greatest, and since the two outermost contact points of the first leg 3 are spaced from each other, they exert a bending moment on the two legs 3. If the distance of the two contact regions 7, 8 is small in the tensile direction, mutually exerted bending moments of the first legs 3 on each other can be kept at a low level. It can thus also be prevented that the first legs 3 are bent by a bending moment caused by this pressing, as a result of which the first leg 3 can also be formed in a comparatively slender manner. The maximal distance and spacing between the first contact area and the second contact area 14 and the tensile direction 15 are illustrated in FIGS. 1 and 2.

By combining these features, a coupling element 2 can thus be formed which itself can absorb high tensile forces, wherein the inner first leg 3 is formed in an especially slender way in comparison with the outer second leg 5, whereby the second leg 5 can thus take up the critical bending moments in an especially good manner.

This leads to the advantage that a barrier wall element 1 can be formed which is easy to handle since the barrier wall element 1 can be coupled at both face ends irrespective of its orientation and without any intermediate pieces. As a result of the shape of the coupling part 2 it is especially advantageously tension-proof and formed in a material-saving manner because the occurring tensile forces are divided uniformly among the two legs 3, 5, and even in the case of a commencing deformation an interlocking connection is still reliably provided.

Furthermore, a vehicle restraint system comprising a plurality of such barrier wall elements 1 is provided, wherein the barrier wall elements 1 are coupled to each other by means of the coupling parts 2. FIGS. 1 and 2 show two mutually connected coupling parts 2 of adjoining barrier wall elements 1.

The barrier wall element 1 can especially comprise a concrete body 10, which is provided to absorb the impact impulse. The concrete body 10 can consist of concrete or a concrete mixture. The concrete body 10 can comprise a bearing surface 11 on the bottom side. It can further be provided that the concrete body 10 comprises a New-Jersey-type profile or a step profile.

A tension element 12 can be arranged in an especially preferred manner in the concrete body 10, which tension element 12 can extend in an especially continuous manner in the concrete body 10, and is provided to absorb the tensile forces acting on the concrete body 10 in the case of an impact. The at least one tension element 12 can be cast into the concrete body 10.

The at least one tension element 12 can especially be made from metal, preferably from steel, especially from reinforced steel. Since the tension element 12 is protected from environmental influences by the concrete body 10, the tension element 1 can be formed especially free from any surface finishing, e.g. non-galvanised steel.

The at least one tension element 12 can be a reinforcing bar or a reinforcing cable.

The at least one tension element 12 can further be formed to comprise plastic fibres, especially aramid fibres, or carbon fibres.

The at least one tension element 12 can preferably be connected to at least one coupling part 2, especially both coupling parts 2. In this case, the coupling parts 2 and the tension element 12 can especially form the part of the barrier wall element 1 which absorbs the tensile forces.

Figure 3:
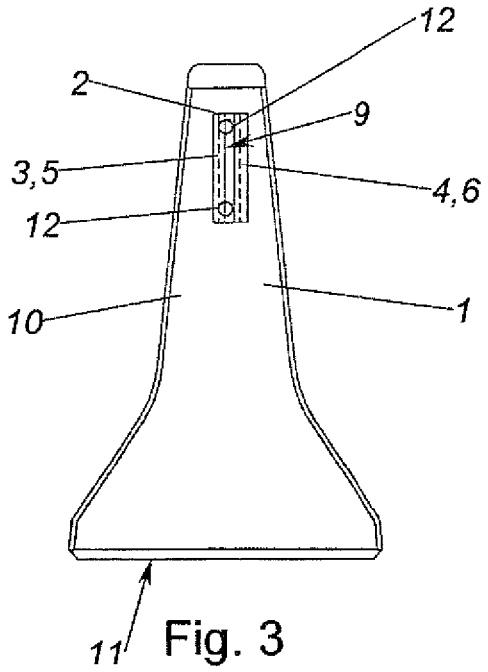
FIG. 3 shows a first preferred embodiment of the barrier wall element in a front view.
Figure 4:
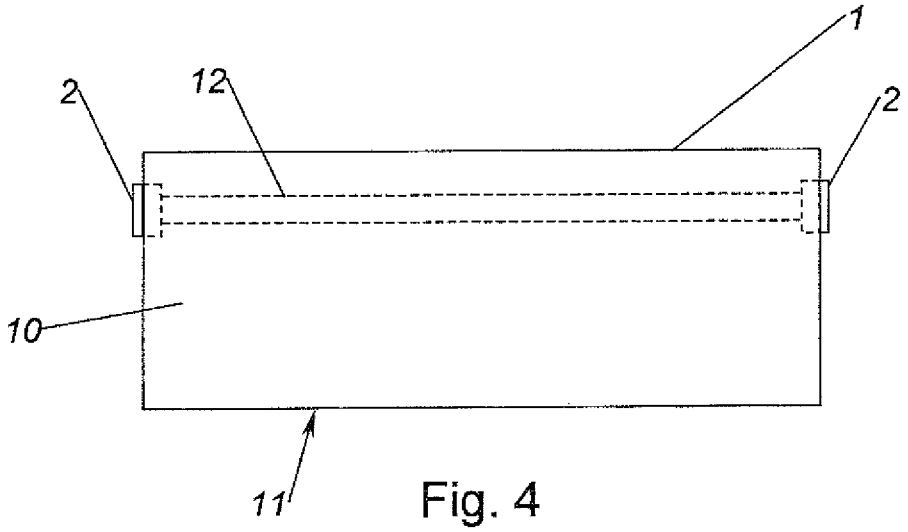
FIG. 4 shows the first preferred embodiment of the barrier wall element in a side view.

FIGS. 3 and 4 show the arrangement according to the first embodiment of the coupling parts 2, the concrete body 10 and the tension element 12 with respect to each other, wherein covered elements are shown by the dot-dash line.

It can preferably be provided that the coupling part 2 comprises a connecting section 13 for connecting the coupling part 2 to the tension element 12. Both legs 3, 5 can be especially integrally formed at one end of the connecting section. The connecting section can especially be arranged in a central plane of the barrier wall element 2 extending in the tensile direction. The tensile forces can thus be conducted to the tension element 12, without producing bending moments within the concrete body 10.

The connection of the coupling part 2 with the tension element 12 can occur in different ways, e.g. by welding, gluing or an interlocking connection.

It can preferably be provided that the barrier wall element 1 comprises a coupling part 2 at both ends, wherein especially preferably a respective coupling part 2 is arranged on a first face end and a second face end of the concrete body 10. In this case, the coupling parts 2 can preferably protrude from the respective face end of the concrete body 7.

The coupling parts 2 can especially comprise a corrosion-resistant material, especially corrosion-proof steel and/or a corrosion-proof surface finishing, preferably in form of galvanising.

It can preferably be provided that the distance of the first contact region 7 from the second contact region 8 is smaller in the tensile direction of the tension member than a half, especially a quarter, of the first width of the first leg 3. The advantageous effect that the first legs 3 rest on each other at their reinforced free ends is amplified with decreasing distance.

It can further be provided that a distance between the second hook extension 6 and the sliding surface 9 corresponds to a sum total of the first width of the first leg 3 and a predeterminable gap width. In order to connect the two coupling parts to each other or separate them from each other, a certain amount of play between the first legs 3 with respect to each other is advantageous, which play can be formed as a gap between the two sliding surfaces 9. Said gap is clearly shown for example in FIG. 2. It is advantageous if this gap does not exceed a predeterminable gap width so that the first legs 3, in the event of a deformation during impact of a vehicle, can rapidly rest on each other, as a result of which the deformation of the first legs 3 can be kept to a low level under major tensile loading.

It can be provided in an especially preferred way that the predeterminable gap width is smaller than 50%, especially 30%, more preferably 10%, of the first width. A compact configuration is possible with these gap widths, wherein the first legs 3 can hardly deform.

It can further be provided that the sliding surface 9 is arranged in a first plane, and that the first plane is tilted relative to the tensile direction by 3° to 30°, especially 10° to 20°. The tilting axis is perpendicular in this case, wherein the first plane is tilted in the direction of the first extension 4. It can thus be achieved, even in the case of a deforming first leg 3, that the sliding surface 9 is not bent in such a way that an undercut is formed. Such a sliding surface 9 is shown in the embodiment in FIG. 1.

The sliding surface 9 can alternatively be arranged in the first plane, wherein the first plane extends in the tensile direction. Such a sliding surface 9 is shown in the embodiment in FIG. 2.

It can further preferably be provided that the sliding surface 9 is substantially arranged in an extension of a perpendicular central plane of the barrier wall element 1 which extends in the tensile direction.

It can be provided in an especially preferred way that the first hook extension 4 and/or the second hook extension 6 are formed with an undercut. The fact that the first hook extension 4 and/or the second hook extension 6 are formed with an undercut means in this case that the first hook extension 4 and/or the second hook extension 6 comprise at least one surface in the respective contact region 7, 8 which, following the progression of the respective hook extension 4, 6 in the direction of its free end, comprises at least one component against the tensile direction. It can thus be achieved that in the case of a substantially deformation-free tensile loading only the contact regions 7, 8 are loaded and the first legs 3 are not pressed against each other at their sliding surfaces 9.

Alternatively, the first hook extension 4 and/or the second hook extension 6 merely comprise one surface in the respective contact region 7, 8, which surface stands normally to the tensile direction.

It can preferably further be provided that the first leg 3 has a substantially uniform width from an attachment point to the free end. The attachment of the first legs 3 can be integrally formed on the connecting section 13. Since the first leg 3 substantially only transmits tensile forces in the tensile direction, it can have a material-saving form with a constant width. This substantially constant width corresponds to the first width.

The first width can especially be between 5 mm and 20 mm, preferably between 10 mm of 15 mm.

It can especially be provided that the second leg 5 has a substantially constant width from an attachment point up to the free end.

It can further be provided that the first hook extension 4 and/or the second hook extension 6 are formed as a bent end of the respective leg 3, 5. In this case, a width of the hook extension 4, 6 corresponds to the width of the respective leg 3, 5. The coupling part 2 can thus be formed in a simple way.

It can preferably be provided that the second leg 5 is wider than the first leg 3. The second leg 5 can thus take up the occurring bending moments especially well when the second leg 5 is pressed to the outside under a very strong tensile loading.

It can further be provided that at least one reinforcing rib is integrally formed on an exterior side of the second leg 5. The reinforcing rib can be formed on the exterior side of the second leg 5 so as to follow the progression of the second leg 5, especially over the entire exterior side. A width of the reinforcing rib can especially be 50% to 200% of the width of the second leg 5. As a result of the reinforcing rib, the resilience of the second leg 5 against forces which try to bend the second leg 5 to the outside can be increased with little material input.

What is claimed is:

1. A barrier wall element of a vehicle restraint system, said barrier wall comprising:

a coupling part configured to connect the barrier wall element to an identical further coupling part of another barrier wall element to form a continuous tension member, said coupling part including a first leg which has a free end forming a first hook extension and a sliding surface arranged on a side of the first leg which side faces away from the first hook extension, and a second leg having a free end forming a second hook extension, wherein, in a coupled state of the coupling parts, the first hook extension rests in a first contact region on the second hook extension of the further coupling part, and the second hook extension rests in a second contact region on the first hook extension of the further coupling part, with the first and second contact regions being spaced from one another in a tensile direction of the tension member by a distance which is smaller than a width of the first leg, wherein, in the coupled state, the sliding surface of the first leg faces a sliding surface of the first leg of the further coupling part, so that the first leg of the coupling part and the first leg of the further coupling part do not hook into each other in an interlocking manner, but slide on each other.

2. The barrier wall element of claim 1, wherein the distance of the first contact region from the second contact region in the tensile direction of the tension member is smaller than a half of the width of the first leg.

3. The barrier wall element of claim 1, wherein the distance of the first contact region from the second contact region in the tensile direction of the tension member is smaller than a quarter of the width of the first leg.

4. The barrier wall element of claim 1, wherein the second hook extension and the sliding surface are spaced from one another by a distance which corresponds to a sum total of the width of the first leg and a predeterminable gap width.

5. The barrier wall element of claim 4, wherein the predeterminable gap width is less than 50% of the width of the first leg.

6. The barrier wall element of claim 4, wherein the predeterminable gap width is 30% of the width of the first leg.

7. The barrier wall element of claim 4, wherein the predeterminable gap width is 10% of the width of the first leg.

8. The barrier wall element of claim 1, wherein the sliding surface is arranged in a first plane which is tilted relative to the tensile direction by 3° to 30°.

9. The barrier wall element of claim 1, wherein the sliding surface is arranged in a first plane which is tilted relative to the tensile direction by 10° to 20°.

10. The barrier wall element of claim 1, wherein the sliding surface is substantially arranged in an extension of a perpendicular central plane of the barrier wall element which central plane extends in the tensile direction.

11. The barrier wall element of claim 1, wherein at least one of the first and second hook extensions is formed with an undercut.

12. The barrier wall element of claim 1, wherein at least one of the first and second hook extensions is formed by bending the free end.

13. The barrier wall element of claim 1, wherein the first leg has a substantially constant width from an attachment point up to the free end.

14. The barrier wall element of claim 1, wherein the second leg has a width which is greater than the width of the first leg.

15. The barrier wall element of claim 1, further comprising a reinforcing rib integrally formed on an exterior side of the second leg.

16. A vehicle restraint system, comprising a plurality of barrier wall elements, each said barrier wall element comprising a coupling part configured to connect the barrier wall element to an identical further coupling part of an adjacent one of the barrier wall elements to form a continuous tension member, said coupling part including a first leg which has a free end forming a first hook extension and a sliding surface arranged on a side of the first leg which side faces away from the first hook extension, and a second leg having a free end forming a second hook extension, wherein, in a coupled state of the coupling parts, the first hook extension rests in a first contact region on the second hook extension of the further coupling part, and the second hook extension rests in a second contact region on the first hook extension of the further coupling part, with the first and second contact regions being spaced from one another in a tensile direction of the tension member by a distance which smaller than a width of the first leg, wherein, in the coupled state, the sliding surface of the first leg faces a sliding surface of the first leg of the further coupling part, so that the first leg of the coupling part and the first leg of the further coupling part do not hook into each other in an interlocking manner, but slide on each other.

* * * * *